US007980455B2

(12) United States Patent
Leiva Burgos

(10) Patent No.: US 7,980,455 B2
(45) Date of Patent: Jul. 19, 2011

(54) FOLDABLE URBAN WASTE CONTAINER

(76) Inventor: Gloria Ivette Leiva Burgos, Concepción (CL)

( * ) Notice: Subject to any disclaimer, the term of this patent is extended or adjusted under 35 U.S.C. 154(b) by 0 days.

(21) Appl. No.: 12/502,526

(22) Filed: Jul. 14, 2009

(65) Prior Publication Data

US 2010/0230482 A1 Sep. 16, 2010

(30) Foreign Application Priority Data

Mar. 12, 2009 (CL) ..... 0583-2009

(51) Int. Cl.
*A47G 29/12* (2006.01)

(52) U.S. Cl. ..... 232/1 R; 220/8; 220/908; 248/129; 232/43.5

(58) Field of Classification Search ..... 232/1 R, 232/43.1, 43.2, 43.5; 220/908, 908.1, 908.2, 220/908.3, 6–8; 280/30, 47.18, 47.26; 248/129
See application file for complete search history.

(56) References Cited

U.S. PATENT DOCUMENTS

| | | | | |
|---|---|---|---|---|
| 3,127,052 | A * | 3/1964 | Mayers | 220/495.11 |
| 3,329,298 | A * | 7/1967 | Demas | 220/8 |
| 4,726,485 | A * | 2/1988 | Bailey | 220/6 |
| 5,445,397 | A * | 8/1995 | Evans | 280/47.18 |
| 5,595,395 | A * | 1/1997 | Wilson | 280/47.26 |
| 5,862,932 | A * | 1/1999 | Walsh et al. | 220/8 |
| 6,073,943 | A | 6/2000 | Serrault | |
| 6,315,143 | B1 * | 11/2001 | Dotts | 220/9.2 |
| 7,107,934 | B1 * | 9/2006 | Hanks | 119/170 |
| 7,490,731 | B2 * | 2/2009 | Hautop | 220/495.1 |
| 2002/0096518 | A1 * | 7/2002 | Foster, Sr. | 220/8 |
| 2006/0261143 | A1 | 11/2006 | Sola Barbarin et al. | |
| 2009/0120930 | A1 * | 5/2009 | Sexton | 220/8 |
| 2010/0201090 | A1 * | 8/2010 | Henniges et al. | 280/47.26 |

FOREIGN PATENT DOCUMENTS

| | | |
|---|---|---|
| ES | 1 044 708 | 6/2000 |
| ES | 1 048 973 | 5/2001 |

* cited by examiner

*Primary Examiner* — William L. Miller
(74) *Attorney, Agent, or Firm* — Merchant & Gould P.C.

(57) ABSTRACT

An urban waste container that has a foldable/collapsible body, similar to a caterpillar with a tubular form, that comprises a main body consisting of 3 areas called first module, second module and third module; a top lid; a supporting bracket; and a curved axis/shaft.

7 Claims, 14 Drawing Sheets

FOLDABLE URBAN WASTE CONTAINER

This application claims benefit of Serial No. 583-2009, filed 12 Mar. 2009 in Chile and which application is incorporated herein by reference. To the extent appropriate, a claim of priority is made to the above disclosed applications.

STATE OF THE ART

At the present time urban waste containers, because of their particular characteristics, are a problem for city employees who have to remove such waste, because they are forced to adopt unnatural postures and make excessive effort to lift the containers, resulting in lower back injuries. To provide a solution to this situation, an ergonomic container has been developed for which the following factors have been considered: load weight, lifting frequency, container height in relation to the sanitation worker, load form, time needed for loading, as well as the cleaning ease and esthetics of the container.

INDUSTRIAL PROPERTY STATE

A search was made in the main national and international patent offices and some documents were found that are related to the present invention. These documents are described as follows:

1.—Invention Patent ES9902975 (1999): Urban Waste Container.

This technology protects a container for urban waste that comprises a body with a hinged lid attached to the sides of the body, in addition to a system of ground support that is mechanically connected to the lid, blocking its opening action. The mechanical connection between the supports and the lid includes a rocker arm, which by means of a cable holds the lid in place through a piece that is hinged to the lid. The supports have a spring mechanism that keeps them in a their salient position for ground contact and which, when the container is lifted, give way to allow the lowering of the supports and thereby the opening of the lid when it is activated.

2.—Invention U.S. Pat. No. 6,073,943 (2000): Container for Collecting Trash and Method for Operating Same.

This invention protects a container for waste collection that comprises a back wall, a front wall and two side walls that connect the front and back walls and a bottom wall. The two side walls are deformable and can be folded into themselves to allow the front and back walls to come together; the bottom wall is attached with a pivot device to one of the front and back walls. Each side wall comprises two sheets hinged together on one edge, and hinged respectively on the opposing edge to the back wall and the front wall. The front and back walls and the sheets are produced by extrusion blow molding or by high density polyethylene injection.

3.—Invention Patent ES1048973U (2001): Container for Recyclable Waste.

This invention protects a container for recyclable waste consisting of a receptacle that has an interior division into compartments and that is closed with a removable lid, said receptacle also including grips and a means of rotation for relocation. The lid is hinged to the receptacle and the compartments are formed by removable panels that fit together inside the receptacle. These compartments consist of smaller receptacles that constitute the container and that fit together and are removable within the interior. In addition the grips are fixed and foldable. The receptacle contains a lid that opens by means of a pedal at the bottom.

4.—Invention Patent Application US2006261143 (2006): Selective Waste Container.

This invention protects a selective waste container with a prismatic body, open frontally, the bases of which are on both rectangular frames, so that the body opens both above and below. Inside this body there is a swinging drawer, that is therefore accessible both through the front of the body as well as from above by tipping an upper tray in the function of a lid. The container is specially conceived for domestic use.

In accordance with the previously given information, in the previous art there was no document found that reproduces our invention.

DETAILED DESCRIPTION

Figure 1A:
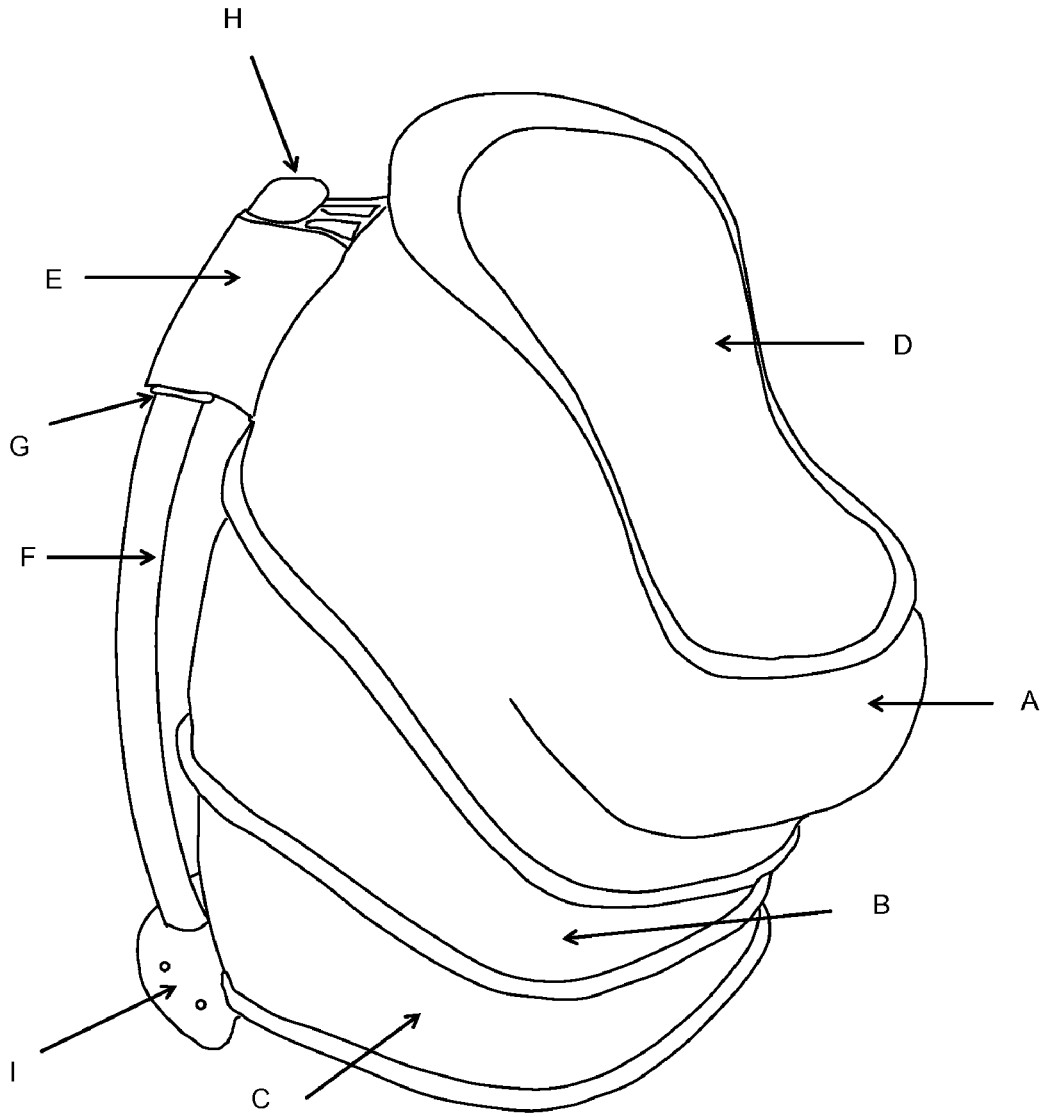
FIG. 1A is a perspective view of the side of the waste container with maximum capacity.
Figure 1B:
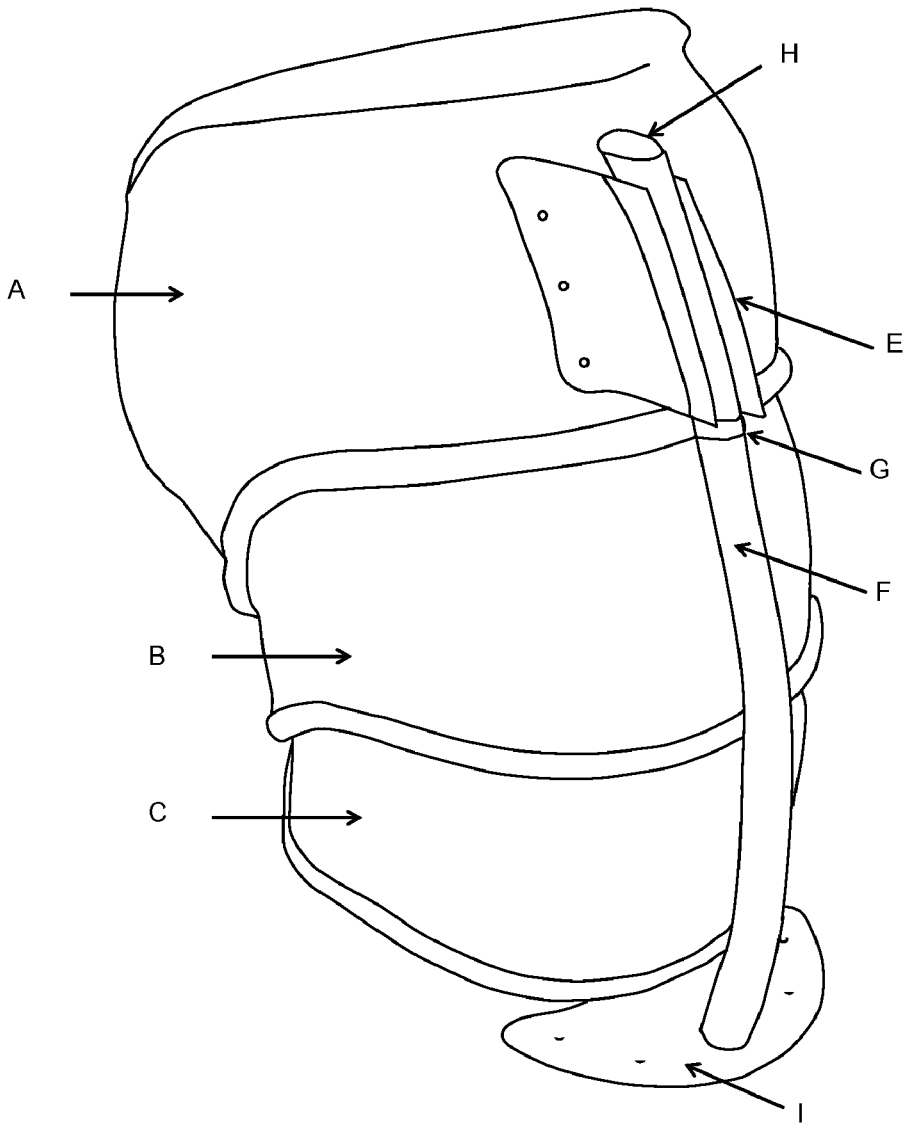
FIG. 1B shows a view, also perspective, of the back of the waste container with maximum capacity.

The invention is a foldable/collapsible urban waste container, as presented in FIG. 1, that comprises a main body made up of 3 areas called the first module (A), second module (B) and third module (C); an upper lid (D); a supporting bracket (E); and a curved axis/shaft (F). It is made of smooth sheets of high density polyethylene (HDPE), and its preferred but not exclusive dimensions are 0.5-0.7 m. long, 0.6-0.7 m. wide, 0.9-1 m. high, with a wall thickness of 0.001-0.005 m, the said dimensions allowing easy handling of the container and an appropriate posture on the part of personnel responsible for the removal of urban waste, since they can remain upright.

This technology has a hinged lid over the top of the container, preventing rain water and the sun from accelerating the decomposition of organic material with the resulting emission of unpleasant odors. It has an elongated form with rounded edges and at the bottom a cylindrical steel projection, a steel axle, that can be inserted into two slots in the first module of the container for rotation purposes. It is provided with a handle that is screwed into the lower side of the lid.

Figure 2A:
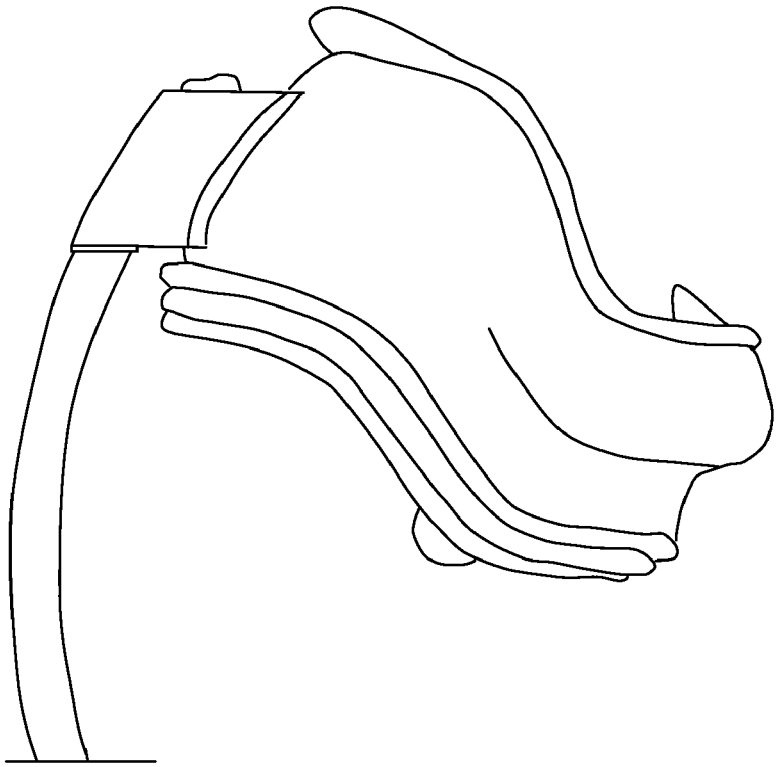
FIG. 2A shows a side view of the waste container in which the first module contains the second and third module.
Figure 2B:
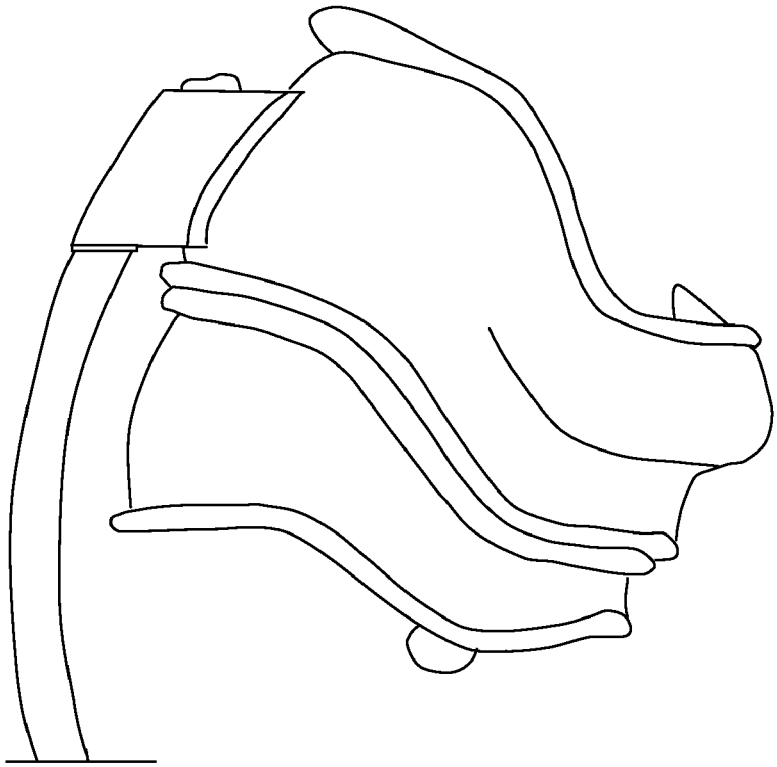
FIG. 2B is a side view of the waste container in which the first and second modules are extended.
Figure 2C:
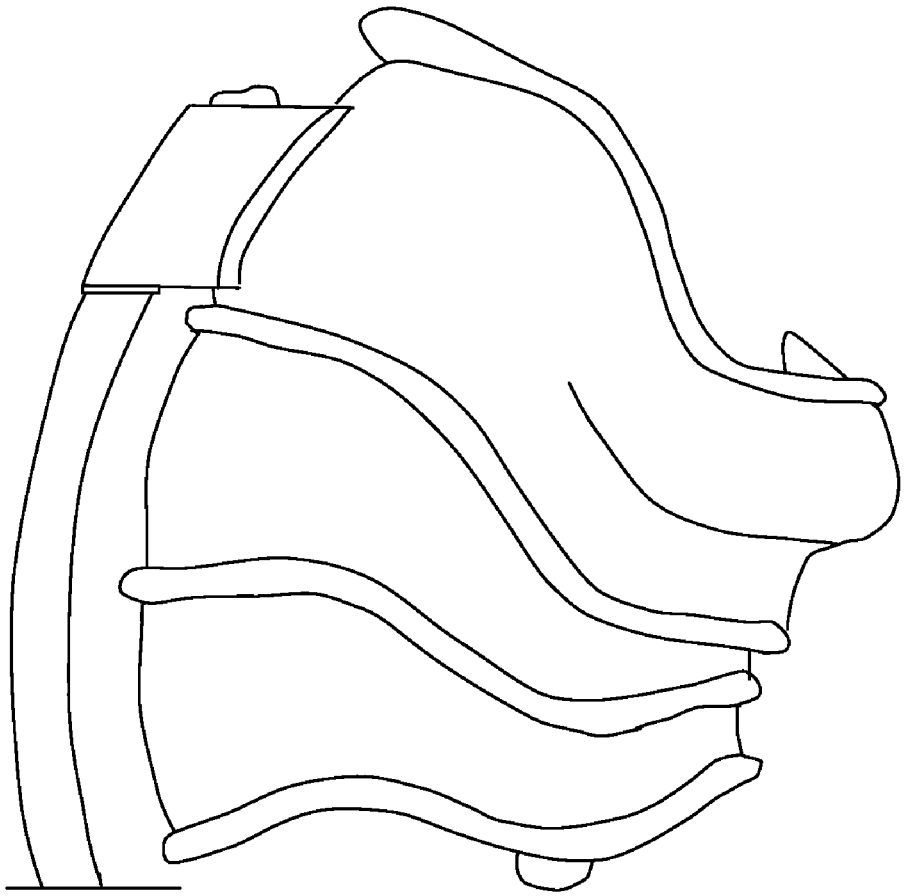
FIG. 2C presents a side view of the waste container with all its modules extended, that is, at its maximum volumetric capacity.
Figure 3A:
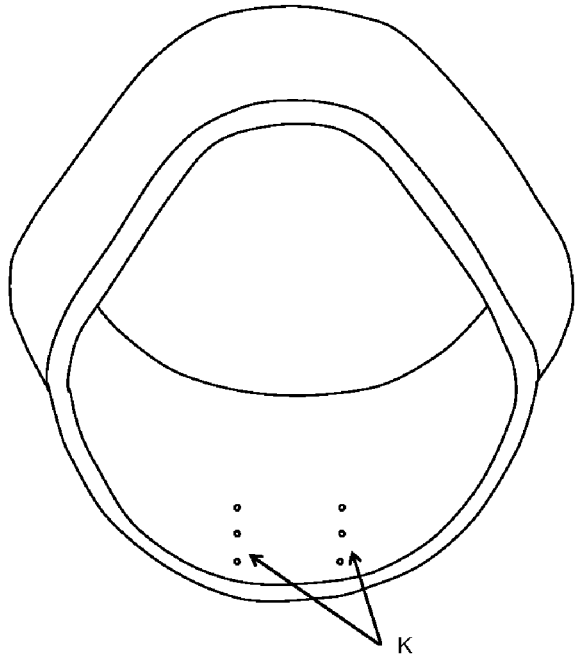
FIG. 3A is a bottom view of the first module of the waste container.
Figure 3B:
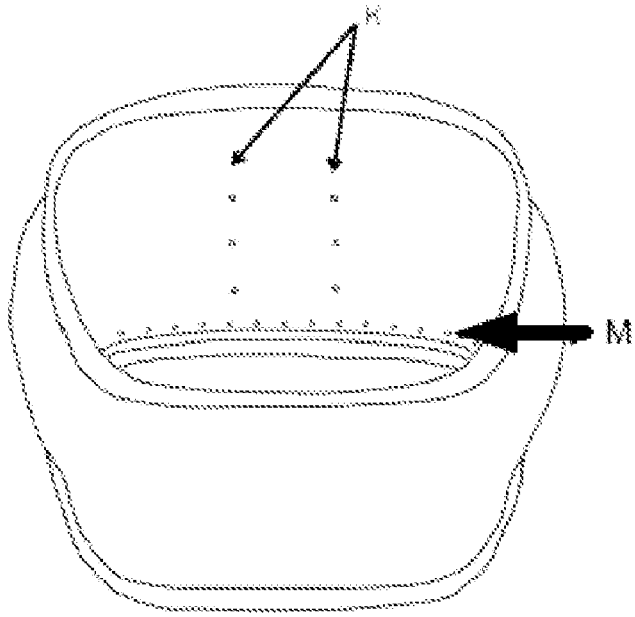
FIG. 3B is a front view of the first module of the waste container.
Figure 3C:
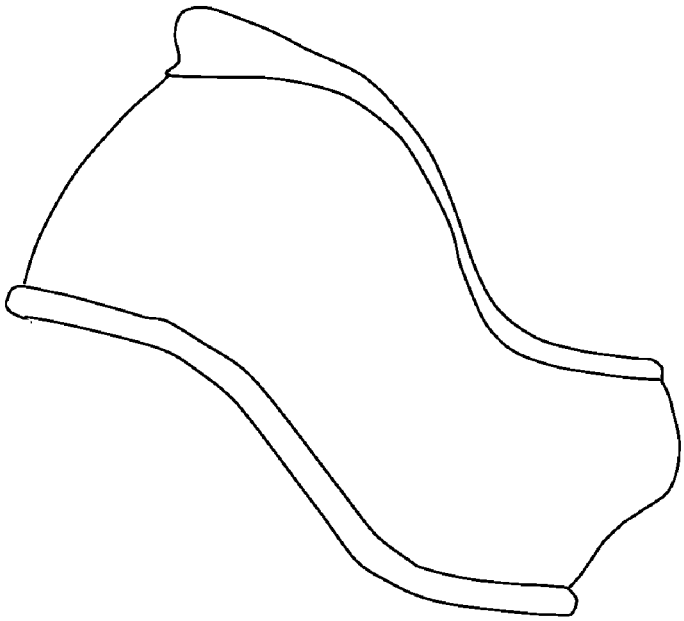
FIG. 3C is a side view of the first module of the waste container.
Figure 3D:
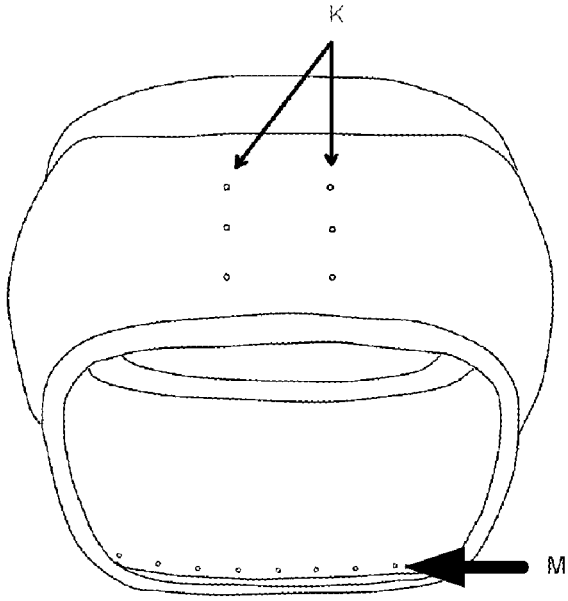
FIG. 3D is a back view of the first module of the waste container.
Figure 3E:
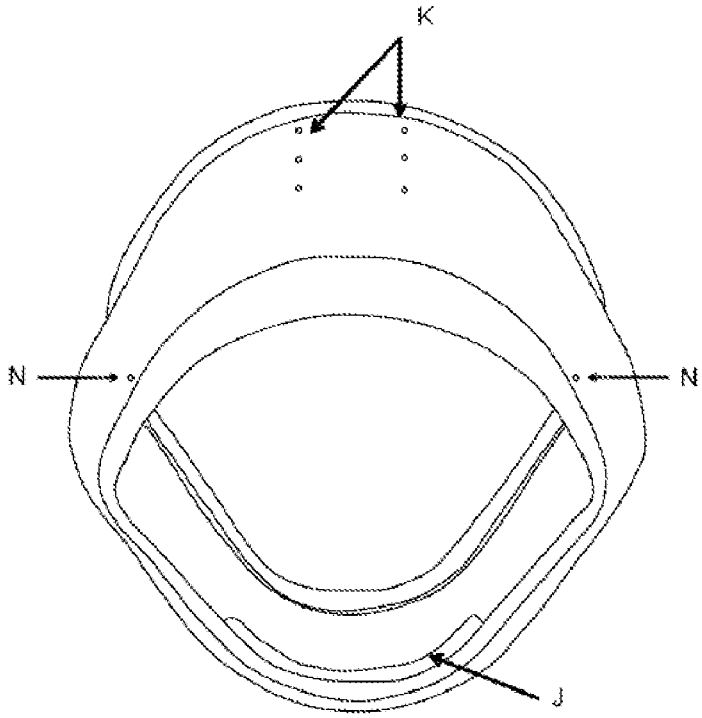
FIG. 3E shows a view from above of the first module of the waste container.

The main body of the waste container has an ergonomic design similar to a caterpillar with a tubular formation, divided into three segments with rounded edges. The first module has the special characteristic that it contains the other two, so that the size of the modules progressively decreases from the first to the third in order to permit folding and the insertion of the second and third into the first. When the pressure exerted by the waste materials exceeds the permitted weight in the first module, successive movements are produced that allow expansion. This progressive increase in the capacity of the waste container is possible because of the use of spherical studs (M) of different sizes inside the container that act as retainers. The size of the studs increases as the volume of waste grows, so that the third module has bigger retainers than the second, so that it opens up when the weight resisted by the previous module is exceeded. The expansion takes place around a curved structure, a form of axis. FIG. 2 presents a schematization of the container in its different positions for storing waste.

Figure 4A:
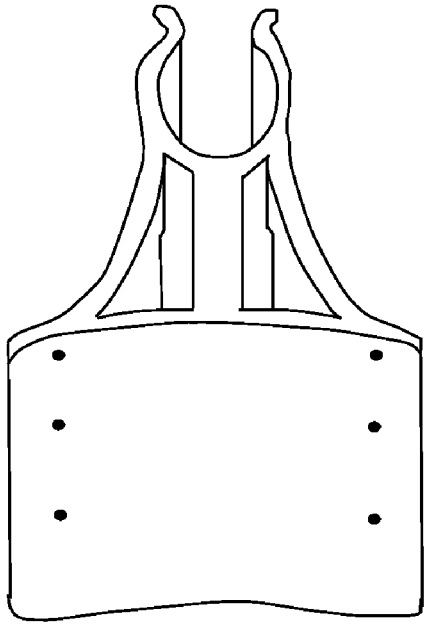
FIG. 4A is a view of the bracket from below.
Figure 4B:
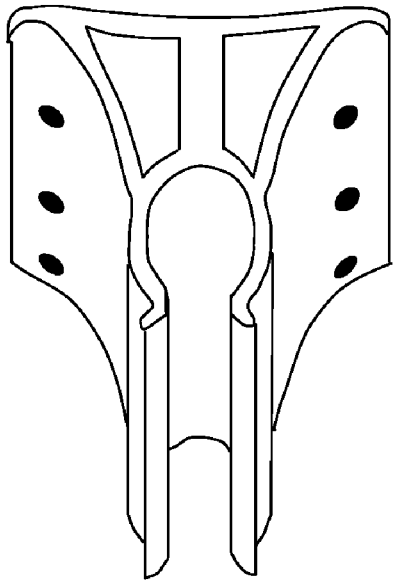
FIG. 4B is a view of the bracket from above.
Figure 5A:
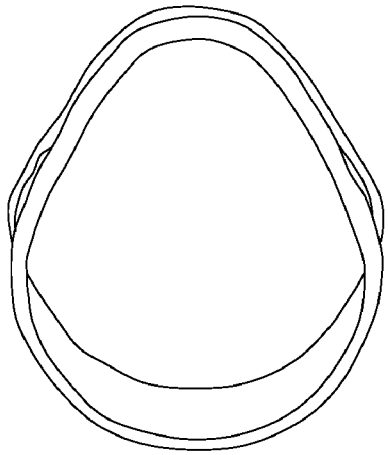
FIG. 5A shows a view from below of the second module of the waste container.
Figure 5B:
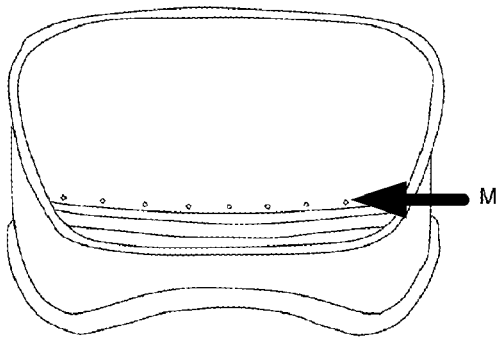
FIG. 5B is a front view of the second module of the waste container.
Figure 5C:
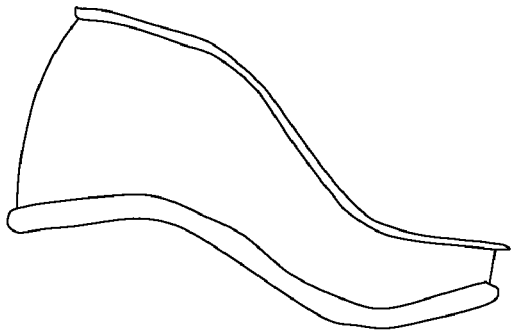
FIG. 5C is a side view of the second module of the waste container.
Figure 5D:
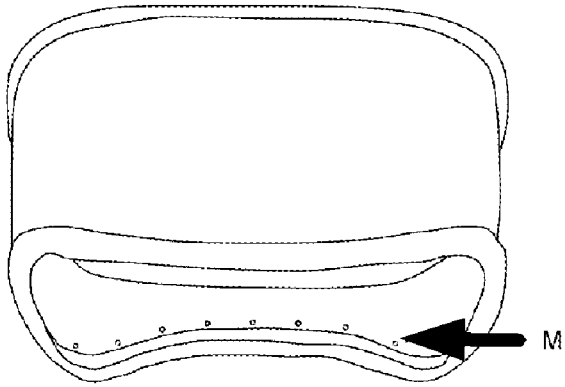
FIG. 5D is a back view of the second module of the waste container.
Figure 5E:
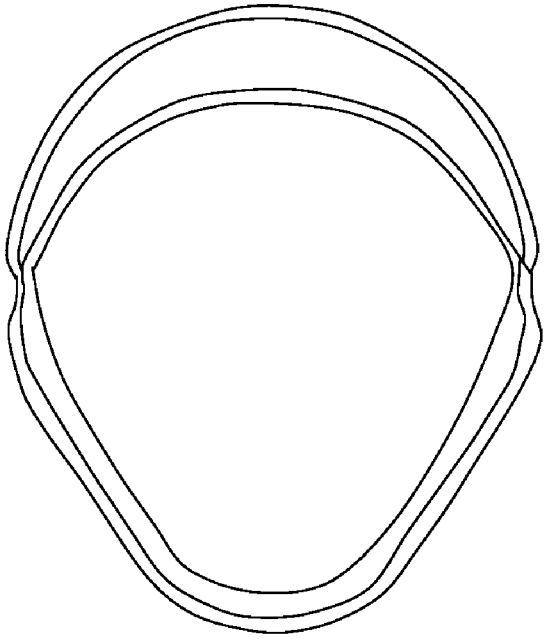
FIG. 5E is a view from above of the second module of the waste container.
Figure 6A:
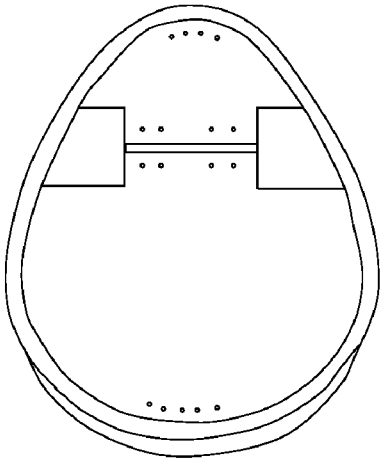
FIG. 6A presents a view from below of the third module of the waste container.
Figure 6B:
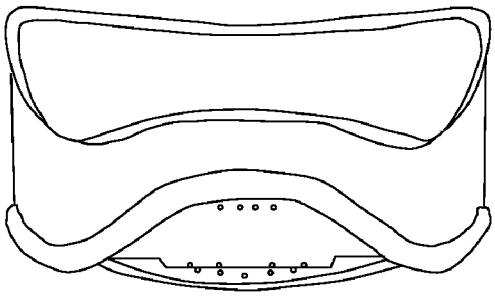
FIG. 6B is a front view of the third module of the waste container.
Figure 6C:
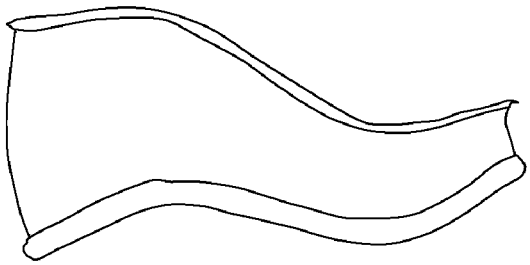
FIG. 6C is a side view of the third module of the waste container.
Figure 6D:
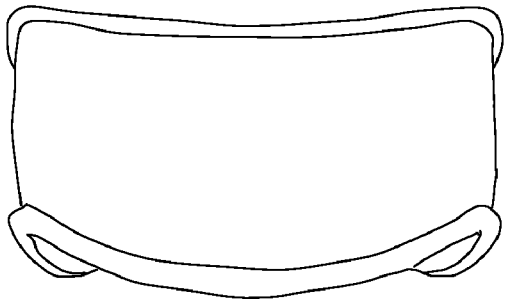
FIG. 6D is a back view of the third module of the waste container.
Figure 6E:
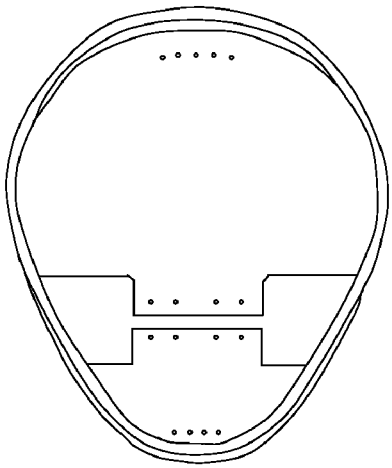
FIG. 6E is a view from above of the third module of the waste container.
Figure 6F:
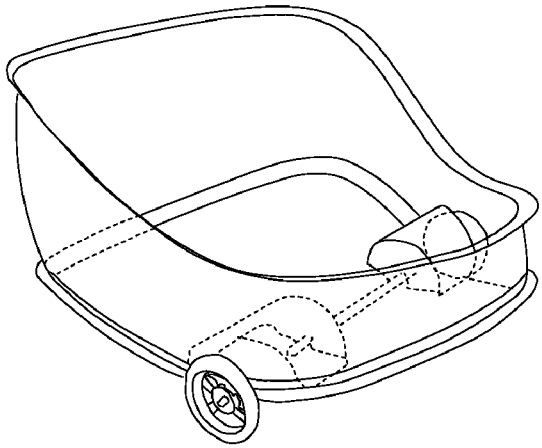
FIG. 6F is a perspective view of the third module of the waste container.

The first module (FIG. 3) is provided with a stop or buffer (J) in the top section that prevents the lid from opening inwards. The handle together with the edge of the lid remain below the edge of this module, allowing it to be raised only through the use of the handle. In addition, in the top front area there are two cylindrical perforations/grooves (N), permitting a connection with the lid axis through pressure, which provides a perfect fit between the axis and the slots, making possible the rotation of the lid from this point. The back of this module has 6 circular perforations/openings (K), placed vertically 3 on each side, which make possible the attachment of a support bracket (see FIG. 4), which is anchored to a fitted curved axis. This bracket, preferably but not exclusively made of nylon 6.6, has a concave section by which it is attached to the curved axis. This attachment occurs because the two parts fit perfectly one over the other and no other accessory is necessary, an operation that is facilitated by using a type of material that does not undergo alterations or wear out.

The second module (see FIG. 5) is smaller than the first, since the length is reduced in order to provide foldability and permit the insertion of the second and third modules inside the first. The third module (FIG. 6) has a bottom and two concavities for two wheels joined through an axle to which washers are soldered for final assembly. The wheels, which make it possible to move the container easily and silently, have a diameter of 0.05-0.2 m, are rubber covered and have an electro-zinc coated axis that has undergone anticorrosion treatment. In addition, in the lower area this module has perforations/apertures in the central and front parts, allowing oxygenation and the evacuation of water when the container is being washed.

Figure 7:
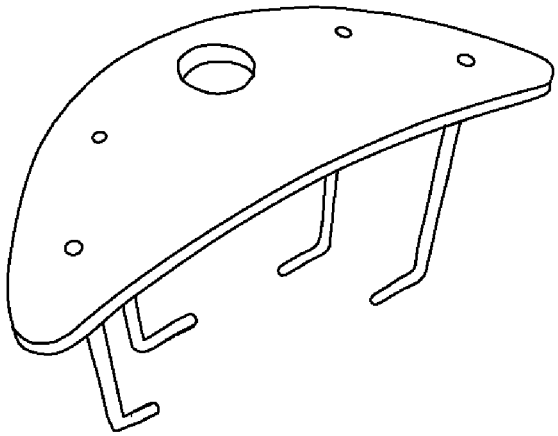
FIG. 7 is a perspective view of the base of the curved axis.

As previously mentioned, the waste container is attached to a curved axis (F) with a curvature radius of 0.7-0.9 m, preferably 0.8 m, a diameter of 0.05-0.07 m and preferably made of electro-zinc coated steel (see FIG. 1). In the upper part, at a height of 0.6-0.8 m above the ground, this axis has a ring (G) that serves as a stop to anchor the support (E); and at its upper end it has a rubber cap (H), attached using pressure. To stand the axis firmly on the ground, an electro-zinc coated base (I) is used (also shown in FIG. 7), provided with at least four perforations/apertures into which at least 4 bolts are inserted in order to anchor it in a square or rectangular pile.

To facilitate the emptying of the container, it is necessary to detach the bracket located on the first module from the curved axis, which is done by effecting a horizontal movement to unhitch the container without lifting and carrying the weight of the waste materials. The container has two wheels on the bottom, which allow the container to be pulled easily at the moment of transfer of contents. When the container is inverted to empty its contents, the movement causes the container to revert to its compact form, that is, with the second and third modules inside the first module. After this operation, the container is re-attached to the axis, once again by means of a horizontal movement. This progressive design reduces the effort level required of the sanitation worker and enables the latter to avoid adopting forced postures, since its caterpillar-like form places the center of gravity closer to the person who is lifting it. This reduces the net force applied at the moment of transfer of the waste, which, with the help of the wheels, permits the worker to merely direct the contents to their final place.

APPLICATION EXAMPLE

Figure 8:
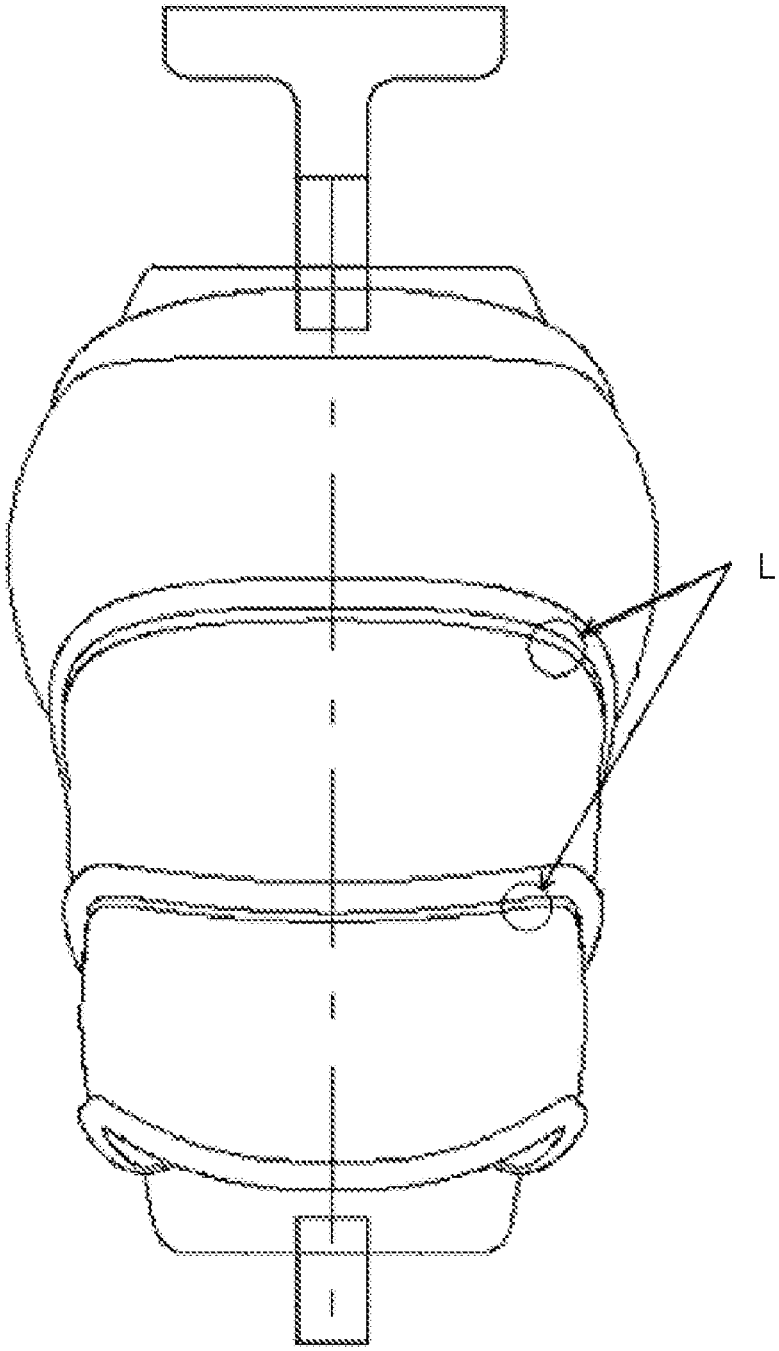
FIG. 8 is a front view of the container, indicating the blower in the upper part and the cutting lines to obtain the three modules.

The container was made by means of extrusion blow molding, a process used for the production of hollow bodies. The raw material used was high density polyethylene pellet, as it offers an excellent combination of rigidity and resistance to shattering through environmental tensions. This process is cheaper and more efficient mainly because of the large size of the molds. The pellets were introduced into an extruder that melted and homogenized the material, which was then passed through a vertical tube (parison), that was grabbed by the two sides of the mold. The mold was closed and a device was introduced that blew air into the tube giving it the form of the mold. These molds were left to cool before removing the modules, which had a wall thickness of 0.003 m. As shown in FIG. 8, the three container modules were blown at the same time and were then separated by cutting them along the lines indicated by the letter (L). In addition, 13 perforations were made in the third mold, 8 in the central part and 5 in the front part for oxygenation and to facilitate cleaning.

The support bracket is a piece that needs elasticity and that should not wear out, for which reason nylon 6.6 was used as the raw material. The process used for its production was injection, as was the case with the lid handle. The axis was made from a steel tube with a curvature radius of 0.8 m and a diameter of 0.05 m.

The lid was made from a high density polyethylene sheet that was molded into shape. For this purpose, the sheet was compressed and temperature was applied to soften it against a cold mold. The thickness of the said lid was 0.003 m.

The two wheels used to move the container had a diameter of 0.1 m, were provided with a rubber covering and a connecting axle, made from electro-zinc coated steel that had been given anticorrosion treatment.

The base of the axis was made from a sheet of electro-zinc coated steel 0.012 m thick, provided with 4 perforations in which 4 round anchor bolts were introduced, serving to attach the rectangular section pile, the dimensions of which were 0.5 m long, 0.4 m wide and 0.4 m high.

The container obtained had the following dimensions: 0.64 m long; 0.54 m wide; 0.95 m high, wall thickness 0.003 m with an approximate volumetric capacity of 0.25 $m^3$.

The invention claimed is:

1. An urban waste container, comprising:

a main body consisting of a first module, a second module, and a third module coupled together in a collapsible arrangement;

a top lid hingedly coupled to an upper area of the first module, wherein the first module comprises a stop member arranged to prevent the top lid from inward displacement, a pair of grooves arranged to receive and permit rotational displacement of the top lid, and six circular openings arranged to receive and secure portions of a support bracket;

a curved shaft arranged to couple to the support bracket, wherein the support bracket is arranged to permit decoupling of the main body from the shaft by horizontal movement; and a plurality of wheels connected by an axle and each partially positioned within a cavity of the third module, the third module comprising a plurality of apertures permitting fluid connection between a space internal the main body and a space external the main body to permit oxygenation and evacuation of fluid from the main body.

2. An urban waste container according to claim 1, wherein the collapsible arrangement of the main body is arranged to minimize net force applied at content transfer due to a modified center of gravity.

3. An urban waste container according to claim 1, wherein the first module contains the second module and the third module, and wherein a size of the first module, second module, and third module is increasingly reduced to provide collapsibility and insertion therein.

4. An urban waste container according to claim 1, further comprising spherical studs in an interior of the main body arranged to permit the main body to progressively expand to increase the capacity of the container as the quantity of waste material in the container increases.

5. An urban waste container according to claim 1, wherein the shaft comprises: a ring positioned at a height of approximately 0.6 to 0.8 m above ground level and configured to anchor the support bracket; and a rubber cap positioned at an upper end that is placed using pressure.

6. An urban waste container according to claim 5, further comprising a steel base configured to secure the shaft in relation to a ground surface, wherein the steel base comprises fastener apertures into which bolts are introduced to anchor the shaft to a pile.

7. An urban waste container according to claim 1, wherein the container has the following dimensional proportions: 0.5 to 0.7 m length; 0.6 to 0.7 meter width; 0.9 to 1.0 m height; and 1 to 5 mm wall thickness.

* * * * *